US009316043B1

(12) United States Patent
Lawrence

(10) Patent No.: US 9,316,043 B1
(45) Date of Patent: Apr. 19, 2016

(54) WINDOW FRAME AND METHOD

(71) Applicant: Barry G. Lawrence, Thomasville, NC (US)

(72) Inventor: Barry G. Lawrence, Thomasville, NC (US)

( * ) Notice: Subject to any disclaimer, the term of this patent is extended or adjusted under 35 U.S.C. 154(b) by 0 days.

(21) Appl. No.: 13/803,997

(22) Filed: Mar. 14, 2013

(51) Int. Cl.
*E05C 1/00* (2006.01)
*E06B 3/50* (2006.01)
*E05D 15/22* (2006.01)

(52) U.S. Cl.
CPC ..... *E06B 3/5063* (2013.01); *E05D 15/22* (2013.01)

(58) Field of Classification Search
CPC ..... E06B 3/5063; E05B 65/0876; E05C 1/10; E05C 1/085
USPC ..... 49/176, 181, 183–185, 449, 404; 292/137, 163, DIG. 20, DIG. 37, 292/DIG. 55
See application file for complete search history.

(56) References Cited

U.S. PATENT DOCUMENTS

| | | | | | |
|---|---|---|---|---|---|
| 172,584 | A * | 1/1876 | Rhodes | 292/163 |
| 607,260 | A * | 7/1898 | Morse | 292/151 |
| 677,544 | A * | 7/1901 | Hipolito | 49/183 |
| 740,015 | A * | 9/1903 | Hipolito | 49/185 |
| 1,183,052 | A * | 5/1916 | Warren | 49/157 |
| 1,531,150 | A * | 3/1925 | Staugaard et al. | 49/175 |
| 1,749,589 | A * | 3/1930 | Kramer | 49/181 |
| 1,754,316 | A * | 4/1930 | Hamilton | 49/157 |
| 1,859,187 | A * | 5/1932 | Virga | 49/157 |
| 1,911,783 | A * | 5/1933 | Yudes | 292/342 |
| 2,181,745 | A * | 11/1939 | Seibold | 49/183 |
| 5,274,955 | A * | 1/1994 | Dallaire et al. | 49/406 |
| 5,555,684 | A | 9/1996 | Galowitz et al. | 52/204.5 |
| 6,055,782 | A | 5/2000 | Morton et al. | 52/204.1 |
| 6,178,695 | B1 * | 1/2001 | Kornegay et al. | 49/181 |
| 6,311,439 | B1 * | 11/2001 | Arcati et al. | 52/204.51 |
| 6,389,763 | B1 | 5/2002 | Clauss | 52/204.53 |
| 6,832,792 | B2 * | 12/2004 | Polowinczak et al. | 292/36 |
| 7,296,381 | B1 * | 11/2007 | McCabe et al. | 49/454 |
| 7,448,164 | B1 * | 11/2008 | McCabe | 49/185 |
| 8,104,241 | B2 | 1/2012 | Andres | 52/204.53 |
| 2007/0151157 | A1 * | 7/2007 | O'Donnell et al. | 49/181 |
| 2009/0139168 | A1 | 6/2009 | Grissom et al. | 52/288.1 |
| 2010/0083578 | A1 * | 4/2010 | Albrecht | 49/181 |

* cited by examiner

*Primary Examiner* — Katherine Mitchell
*Assistant Examiner* — Abe Massad
(74) *Attorney, Agent, or Firm* — Blake P. Hurt; Tuggle Duggins P.A.

(57) ABSTRACT

A double hung window with a tiltable sash that will withstand high winds and other severe weather conditions. The tiltable sash utilizes retractable tilt latches with blunt nose bolts and biased stiles which allow the blunt nose bolts to easily slide along the stile faces as the sash is closed. The stiles may be biased at a 45° or other angle or may be arcuate in shape for easy closing.

7 Claims, 3 Drawing Sheets

WINDOW FRAME AND METHOD

FIELD OF THE INVENTION

The invention herein pertains to windows having tiltable sashes and particularly pertains to double hung windows utilizing tilt latches having blunt nose bolts.

DESCRIPTION OF THE PRIOR ART AND OBJECTIVES OF THE INVENTION

With the convenience in maintenance of tiltable sash windows, more home owners are requesting such windows be installed in their homes. In areas that experience high winds such windows often fail and do not meet current building codes since they can not withstand the stress as well as certain other window types. Accordingly, manufactures are changing the tilt latches from ones having bolts with biased noses which are easy to close to bolts which have blunt noses in order to meet the required stress tests. These blunt nose bolts can scar or damage the face of the window stiles if they are closed thereagainst. Blunt nose bolts have to be manually withdrawn during the closing process to prevent scaring and damage to the window stiles.

Thus, in view of the problems, inconveniences and disadvantages associated with the failure of tiltable sashes with biased nose bolts, stress tests and wind conditions, the present invention was conceived and one of its objectives is to provide a window stile for use in a conventional window frame having a tiltable sash which will allow the stronger blunt nose bolts to easily slide as the tiltable sash is being closed to its upright position.

It is another objective of the present invention to allow a standard blunt nose bolt to be conveniently used in a tilt latch without greater cost to the window manufacturer or user.

It is still another objective of the present invention to provide a window frame which has biased stiles to allow the blunt nose bolts to be used on tiltable sashes and to allow the sashes to easily close.

It is yet another objective of the present invention to provide various types of biased stiles for individual selection and use depending on the particular aesthetics desired.

It is a further objective of the present invention to provide a window frame with biased stiles for use with tiltable sashes having blunt nose latch bolts.

It is still a further objective of the present invention to provide an add-on triangular or other biased stile face which extends the full stile length or partially thereof for use with tilt latches having blunt nose bolts.

Various other objectives and advantages of the present invention will become apparent to those skilled in the art as a more detailed description is set forth below.

SUMMARY OF THE INVENTION

The aforesaid and other objectives are realized by providing a window stile with a biased face for use with tiltable window sashes having tilt latches with blunt nose bolts. Such use of blunt nose bolts will prevent the tiltable sashes from failing under high stress conditions. Further, biased stiles on the windows are employed in combination with the blunt nose latch bolts. The biased stiles can be provided in manufactured windows as a modification to the standard flat stile faces or as an add-on for preexisting windows. The biased stile faces are slanted or biased inwardly 45° or at other angles to allow the blunt nose bolt to slide therealong during sash closing. Although most bolts on conventional tilt latches are spring loaded, the blunt nose bolts will not slide if closed against a standard square faced stile unless the latch bolts are manually withdrawn. If a sash is closed with the blunt nose bolts extending, they strike the conventional flat stiles and can damage or break the stiles, depending on the closing force employed.

The invention herein utilizes biased or curved stiles in a window frame for use with tiltable sashes having tilt latches with blunt nose bolts. The method of use improves the closing ability of the sashes by providing stiles that are biased or curved which allow the blunt nose bolts to easily slide thereover during closing. Thus, the stronger blunt nose bolts can be employed to provide a greater stress-resistant window and convenience during the method of closing by the building occupant.

DETAILED DESCRIPTION OF THE PREFERRED EMBODIMENT AND OPERATION OF THE INVENTION

Figure 1:
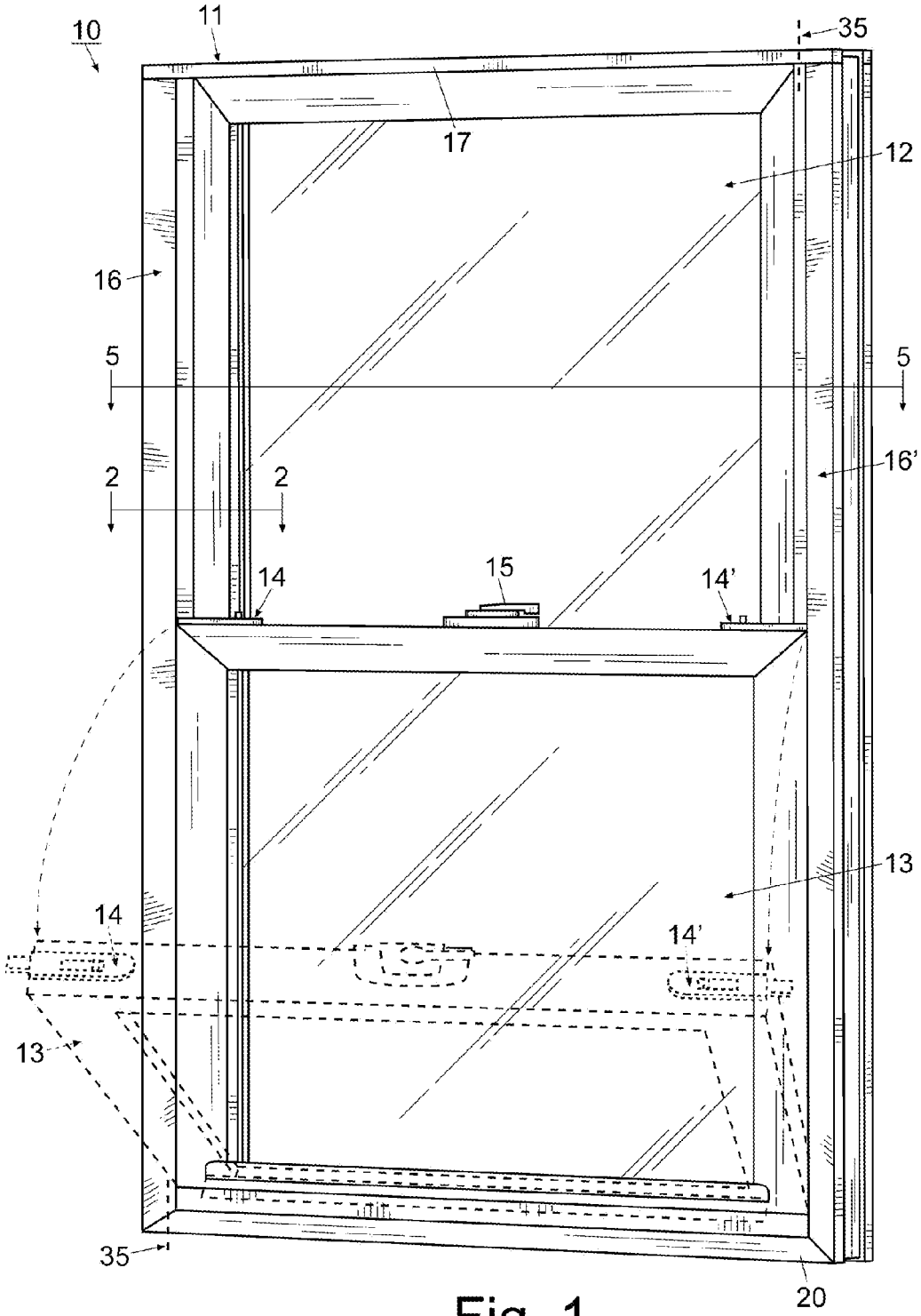
FIG. 1 shows a double hung window in a window frame having biased stiles of the invention with a tiltable lower sash shown closed and in a tilted or opened format using dashed lines.
Figure 2:
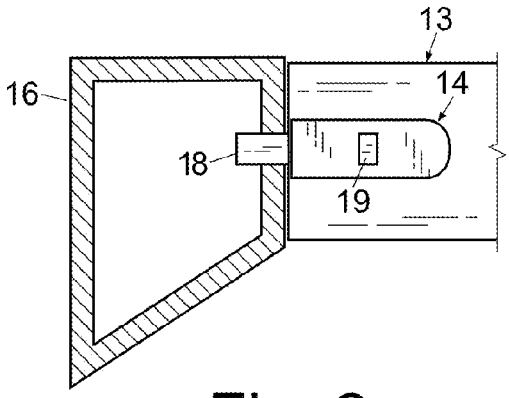
FIG. 2 pictures a cross-sectional fragmented view of the window stile generally as along lines 2-2 of FIG. 1 with the sash and tilt latch blunt nose bolt in a locked or closed position in the window stile.

For a better understanding of the invention and its operation, turning now to the drawings, FIG. 1 demonstrates preferred double hung window 10 having a window frame 11 containing upper sash 12 and lower sash 13. Frame 11 comprises header 17 and opposing base 20 joined respectively by opposing biased stiles 16, 16' to form a rectangle. As shown lower sash 13 is closed within frame 11 in an upright or normal position by tilt latches 14, 14'. Tilt latches 14, 14' have respectively standard rectangular or blunt nose bolts 18, 18' also shown in FIGS. 2, 3, 5, 6 and 7. FIG. 1 also shows lower sash 13 in a tilted or pivoted position (in dashed lines) with tilt latches 14, 14' having been manually closed (retracted) to allow for pivoting action or tilting of sash 13. Standard window lock 15 allows window sashes 12, 13 to be locked in the conventional upright or vertical position in parallel orientation to vertical axis 35 (FIG. 1) defined by each of stiles 16, 16'.

In order for windows to comply with certain government standards and high wind, stress regulations, windows are placed under wind stress tests to demonstrate their reliability under simulated extreme high winds and hurricane conditions. Oftentimes windows function well in ordinary weather but during intense rainstorms, tornadoes, hurricanes and the like the outside air pressure will cause the windows and sashes to collapse or fail.

Figure 3:
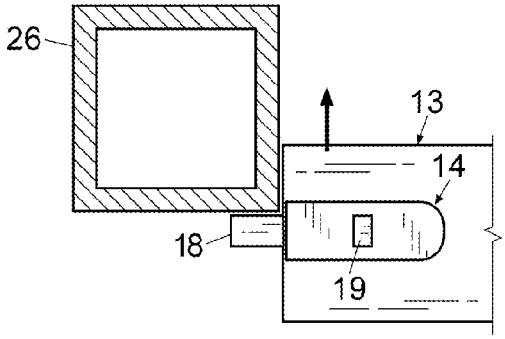
Fig. 3 Prior Art
FIG. 3 depicts a fragmented cross-sectional view of a sash in a conventional window having a flat faced stile being closed with a blunt nose latch bolt contacting the stile and preventing the sash from closing without manual retraction of the latch bolt.
Figure 4:
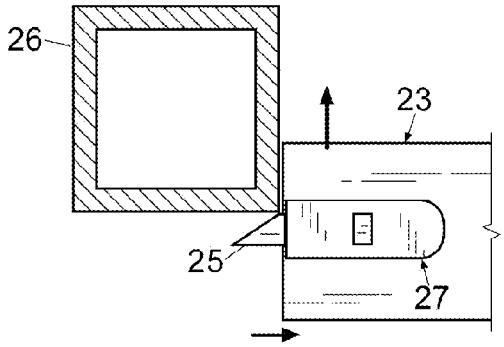
Fig. 4 Prior Art
FIG. 4 demonstrates a fragmented cross-sectional view of a conventional tilt latch having a biased nose bolt which easily closes on a conventional flat stile.

As tilt sash windows are extremely popular for homeowners for cleaning and maintenance purposes, such windows generally employ tilt latches with a beveled or biased bolt nose which allows ease in closing with conventional flat face stiles as shown for example in FIG. 4 with sash 23 having tilt latch 27 with biased bolt nose 25. During closure of sash 13 against standard square or flat face stile 26 as shown in FIG. 3, blunt nose bolt 18 will strike standard flat window frame stile 26 during closure, requiring the user to manually withdraw nose bolt 18 of tilt latch 14 using finger tab 19 in order to fully close sash 13 within the window frame as shown for example in FIG. 2. As most window sashes employ two tilt latches such as latches 14, 14', one on either side of the sash, a user must be careful and somewhat skilled to withdraw both tilt latches simultaneously while closing the sash. Most tilt latches such as tilt latch 27 in sash 23 as shown in FIG. 4 have angled or biased nose bolts 25 which only require pushing or pivoting the window fully to a full upright position as manually withdrawing bolt 25 is not necessary since the angle of nose bolt 25 sliding against stile 26 pushes or retracts nose bolt 25 within tilt latch 27 so as to pass over stile 26. However constant or repetitive impact against stile 26 with blunt nose bolt 18 of tilt latch 14 as shown in FIG. 3 can damage or break stile 26 making it unfit for service and requiring replacement. Such impact may likewise damage or break tilt latch 14 rendering it useless.

Figure 5:
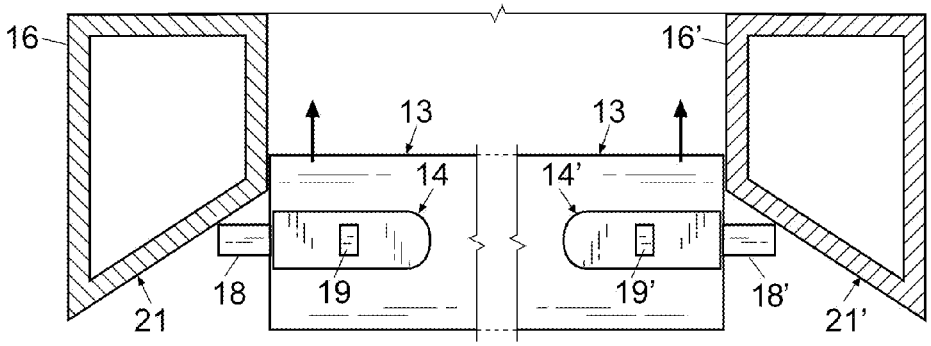
FIG. 5 illustrates schematically a fragmented cross-sectional view of left and right window stiles of the invention generally as along lines 5-5 of FIG. 1 showing the sash having tilt latches with blunt nose bolts being easily closed without manually retracting the latches.
Figure 6:
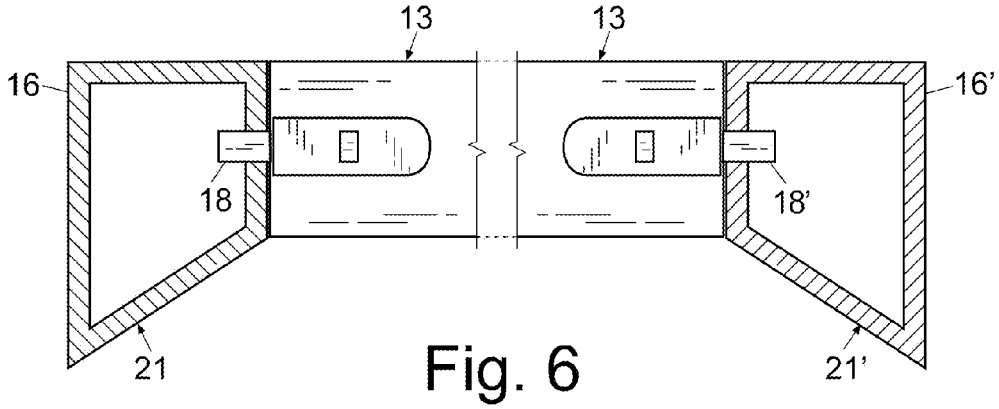
FIG. 6 schematically features the window seen in FIG. 5 with the sash fully closed and locked in place by the blunt nose bolts.

In FIG. 5, preferred window stiles 16, 16' of the present invention are shown in cross-section as seen for example in FIG. 1 through line 5-5. As seen, stiles 16, 16' include respectively biased faces 21, 21'. Biased stile faces 21, 21' are slanted or biased inwardly 45° and could be formed at other angles to allow blunt nose bolts 18, 18' to slide therealong during sash closing. FIG. 5 shows both left and right tilt latches 14, 14' on typical double hung lower window sash 13. As further seen in FIG. 5, tilt latches 14, 14' include respectively finger tabs 19, 19' and blunt nose bolts 18, 18' which are rectangular in shape. Nose bolts 18, 18' do not have to be manually retracted to allow sash 13 to easily close by manual urging due to biased faces 21, 21' of opposing left stile 16 and right stile 16'. As sash 13 is closed bolts 18, 18' contact respectively biased faces 21, 21' and based on the angle thereof and the closing force of sash 13, bolts 18, 18' are easily retracted as they contact and slide along biased faces 21, 21' to allow for full closure of sash 13. In FIG. 6 sash 13 is seen fully closed to its upright position with bolts 18, 18' extended in a locked position within respectively stiles 16, 16'.

Figure 7:
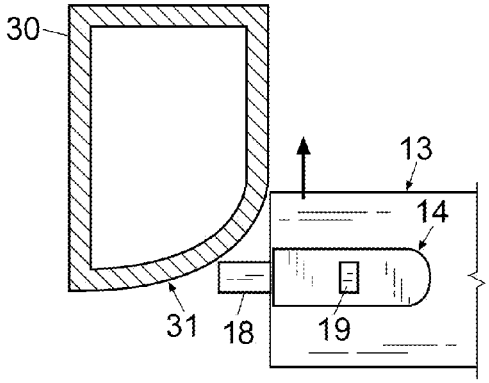
FIG. 7 shows another embodiment of a biased stile of the invention having an arcuate stile face.

In another embodiment of the sash stile of the invention, stile 30 is seen in cross-section in FIG. 7 having arcuate face 31. Blunt nose bolt 18 of tilt latch 14 works well with stile 30 as it allows blunt nose bolt 18 to withdraw into latch 14 as it transgresses stile face 31 and quickly moves to a locked position such as that shown in FIG. 6. Regardless of the embodiment of stile 16 and defined biased faces 21, 31, or other desired shapes, the respective biased face must be oriented and sized to suppress nose bolt 18 sufficiently to allow passage of lower window sash 13 when pivoted within associated stile 16.

While the biased stile faces shown herein are integrally formed such as during the extrusion process of the particular stiles, separate biased or arcuate faces could also be formed as an add-on and attached to standard flat face stiles such as stile 26 seen in FIGS. 3 and 4. These separate add-on faces may or may not extend the full length of the flat face stiles they are attached to. The faces could be attached to the standard stiles on the job site by using preformed legs on the rear of the faces such as by attachment into preformed grooves on the stiles. Also, screws, staples, adhesives or other fastener types as an aftermarket product for use with add-on stiles and blunt nose bolt tilt latches could be used. Such faces could extend the full length of the stiles or could be less than the full length as needed.

The illustrations and examples provided herein are for explanatory purposes and are not intended to limit the scope of the appended claims.

I claim:

1. A window frame in combination with a sash having a tilt latch;

a) the window frame comprising a header, a base, a pair of stiles, each of said stiles connected to said header and said base in opposing relation to form a rectangle, one of said stiles defining a biased face extending substantially an entire longitudinal length of the stile and defining a biased face plane, wherein the biased face plane is parallel to a longitudinal axis of the stile and intersects with a window plane defined by the sash forming an obtuse angle therebetween; and b) said sash tilt latch comprising a retractable bolt, said bolt defining a blunt nose with a symmetrical cross-section relative to a vertical plane defined by said stiles along the longitudinal axis of said bolt; whereby said biased face is sized and oriented to depress said blunt nose of said sash tilt latch and permit sash passage when said sash is returned to said window frame.

2. The combination of claim 1 wherein each of said pair of stiles defines a biased face, each of said biased faces extending substantially an entire longitudinal length of the respective stile and defining a biased face plane, wherein the biased face plane is parallel to a longitudinal axis of the respective stile and intersects with a window plane defined by the sash forming an obtuse angle therebetween.

3. The combination of claim 2 further comprising an additional tilt latch, said additional tilt latch comprising a bolt, said additional tilt latch bolt defining a blunt nose with a symmetrical cross-section relative to a vertical plane defined by said stiles along the longitudinal axis of said bolt.

4. A window frame in combination with a sash having a pair of tilt latches;

a) the window frame comprising a header, a base, a pair of stiles, each of said pair of stiles connected to said header and to said base in opposing relation to form a rectangle, and each of said stiles defining a biased face extending substantially an entire longitudinal length of the respective stile and defining a biased face plane, wherein the biased face plane is parallel to a longitudinal axis of the respective stile and intersects with a window plane defined by the sash forming an obtuse angle therebetween at an obtuse angle; and b) each of said sash tilt latches comprising a bolt, said bolt defining a rectangular nose, whereby said biased faces are each sized and oriented to depress different ones of said rectangular noses of said respective tilt latches when said sash is returned to said window frame.

5. The combination of claim 3 whereby each of said biased faces are sized to depress said rectangular nose of different ones of said sash tilt latches when said sash is returned to said window frame.

6. The combination of claim 1 whereby the obtuse angle defines an angle of one hundred thirty-five degrees (135°).

7. The combination of claim 4 whereby the obtuse angles each define an angle of one hundred thirty-five degrees (135°).

* * * * *